United States Patent [19]

Goodrich et al.

[11] 3,985,179

[45] Oct. 21, 1976

[54] ELECTROMAGNETIC CASTING APPARATUS

[75] Inventors: David G. Goodrich, San Ramon; Ludwig John, Pleasanton, both of Calif.

[73] Assignee: Kaiser Aluminum & Chemical Corporation, Oakland, Calif.

[22] Filed: July 28, 1975

[21] Appl. No.: 599,745

[52] U.S. Cl. ..... 164/250; 164/49

[51] Int. Cl.[2] ..... B22D 27/02

[58] Field of Search ..... 164/250, 251, 49, 146, 164/147

[56] References Cited

UNITED STATES PATENTS

| | | | |
|---|---|---|---|
| 2,686,864 | 8/1954 | Wroughton et al. | 164/49 X |
| 3,605,865 | 9/1971 | Getseler | 164/250 |
| 3,646,988 | 3/1972 | Getseler | 164/250 X |

*Primary Examiner*—J. M. Meister

*Attorney, Agent, or Firm*—Paul E. Calrow; Edward J. Lynch

[57] ABSTRACT

An electromagnetic casting apparatus wherein a ring-type inductor generates an electromagnetic field having a flux density which diminishes in intensity toward the top of the inductor to more efficiently control the shape of the molten metal within the inductor.

8 Claims, 6 Drawing Figures

ELECTROMAGNETIC CASTING APPARATUS

BACKGROUND OF THE INVENTION

This invention relates to an improvement in the continuous or semicontinuous casting of molten metal in an alternating current electromagnetic field to control the shape of the solidifying metal.

Ingots or billets which have been continuously or semicontinuously D.C. cast in conventional open-ended tubular molds are usually characterized by a surface roughened by defects, such as cold folds, liquations, hot tears and the like, which result primarily from contact between the mold and the solidifying embryonic metallic shell. Moreover, conventionally D.C. cast ingot and billet are also characterized by a surface zone which has considerable alloy segragation due to the initial cooling of the molten surface from contact with the mold, reheating of the metal surface after mold contact and then final cooling of the metal surface from the direct application of coolant. Subsequent fabrication steps, such as rolling, extruding, forging and the like, usually require the scalping of the ingot or billet prior to working to remove both the surface defects and the alloy impoverished zone adjacent the surface.

In electromagnetic casting, there is no contact with the embryonic metallic shell during solidification and due to this lack of contact, most surface defects are eliminated. Moreover, due to the lack of contact between the embryonic metal surface and a mold surface, there is usually no cooling, heating, then cooling of the metal surface which causes the formation of the alloy impoverished zone adjacent the surface. As a result, electromagnetically cast metal has an essentially homogeneous composition throughout the entire cross section thereof. Because the electromagnetically cast metal surface is smooth and has essentially no alloy constituent segregation, there is usually no need to scalp the electromagnetically cast material prior to fabrication. Additionally, due to the homogeneous composition and structure, there is considerably less edge cracking during hot rolling so that less edge trimming is necessary after rolling.

The electromagnetic field utilized in electromagnetic casting generates forces normal to the surface of the molten metal which control the shape of the molten metal during solidification. The field is produced by a ring-type inductor and when molten metal is fed to the inner peripheral area of the inductor, the interaction of the electromagnetic field with the eddy currents induced in the molten metal generates the necessary electromagnetic forces which control the cross-sectional shape of the solidifying metal to the same general shape as the inductor. The radial force components generated by the electromagnetic field prevent any significant lateral movement of molten metal and thus no contact between the molten metal and the inductor occurs. With the application of coolant, the molten metal solidifies in the shape induced by the electromagnetic field. A high frequency electrical power source (e.g., 500–3000 cps) is usually employed in electromagnetic casting because at the high frequencies, the induced currents in the molten metal concentrate at the molten metal surface (commonly termed "skin effect") so there is very little turbulence in the molten metal.

The principles of electromagnetic casting are basically the same principles as those of electromagnetic levitation and zone refining, which are all well described in the literature, e.g., see U.S. Pat. No. 2,686,864 (Wroughton et al.) and the Journal of Metals, Vol. 4, pp. 1286–1288 (1952). Getselev and his coworkers developed a practical electromagnetic apparatus for casting large commercial-sized ingots and billet based on these principles. Their design was first described in U.S.S.R. Inventor Certificate No. 233,186 (issued Dec. 18, 1968) and various modifications of the basic design are shown in U.S. Pat. Nos. 3,467,166; 3,605,865; 3,646,988; 3,702,155 and 3,773,101. For additional descriptions of the electromagnetic casting unit and process developed by Getselev et al., see Tsvetnye Met, Aug. 1970, Vol. 43, (8), 64–65 and the Journal of Metals, Vol. 8, October 1971, pp. 38–39. See also U.S. Pat. No. 3,741,280.

Two different ring-type electromagnetic inductors have been described by Getselev and both usually require continual contact with coolant to control the temperature of the inductor. The first type is a hollow inductor internally cooled with a suitable fluid such as water. This type of inductor is difficult and expensive to fabricate and maintain, but nonetheless, it is an effective inductor when properly used. The other type inductor described by Getselev involves a solid inductor disposed within a coolant chamber of the water jacket, preferably in an area where there is a high water velocity to maintain appropriate heat transfer rates. However, this latter method reduces the electromagnetic efficiency due to the increased distance required between the inductor and the molten metal surfaces being controlled. Moreover, the nonmetallic members adjacent the metal being cast may be damaged by metal spills and the like and are also subject to thermal and mechanical distortion.

The radial component of the electromagnetic pressure against the molten metal column generally must be equal to the hydrostatic pressure of the molten metal being shaped. To compensate for the gradually low hydrostatic pressure of the molten metal column progressing toward the upper portions thereof, an electromagnetic shield or screen is preferably positioned between the inductor and the top of the molten metal column to attenuate the electromagnetic field generated by the inductor and thereby gradually reduce the radial forces acting on the molten metal toward the top of the column (see U.S. Pat. No. 3,467,166 — Getselev et al). By this means, the molten metal surface can by maintained relatively straight in the vertical direction and the curvature of the top corners of the molten metal column can be maintained relatively small. Without the electromagnetic screen, the curvature radius of the upper corner or corners of the shaped molten metal can become so large that the curved top surface of the molten metal column intersects with the solidification zone causing severe surface waves and other defects. However, the placement of the electromagnetic shield between the inductor and the molten metal surface being controlled requires positioning the inductor farther away from the molten metal surface, which increases electrical power requirements. Additionally, the electromagnetic shield can consume up to 30 percent or more of the electrical power supplied to the inductor.

Getselev found that large masses of metallic materials are not desired in the immediate vicinity of the electromagnetic inductor because a large metallic mass interferes with the electromagnetic field employed to control the shape of the solidifying ingot and can consume large amounts of energy. For this reason, the water jacket and other components, except for the electromagnetic shield and inductor, are formed of nonmetallic, nonconducting materials, such as micarta, epoxy-bonded fiberglass and the like. However, the nonmetallic, nonconductive members of the water jacket were found to be subject to mechanical and thermal distortions which interfered with the even application of coolant onto the solidifying ingot. Uneven coolant application detrimentally affects surface cooling and severely interferes with the uniform solidification patterns in the metal necessary for high quality ingot or billet. As a result, the nonmetallic parts of the coolant distribution system normally feed frequent maintenance or replacement to maintain the appropriate distribution of coolant around the solidifying metal.

It is against this background that the present invention was developed.

DESCRIPTION OF THE DRAWINGS

FIG. 2 and 3 illustrate an inductor having inclined grooves milled into the upper inside surface of the inductor.

FIG. 4 illustrates another embodiment of the invention wherein the upper inside surface of the inductor is increasingly roughened toward the top thereof.

FIG. 5 is a partial cross-sectional view of another embodiment of the invention employing two inductors, with the top inductor having an inclined innermost surface.

DESCRIPTION OF THE INVENTION

Figure 1:
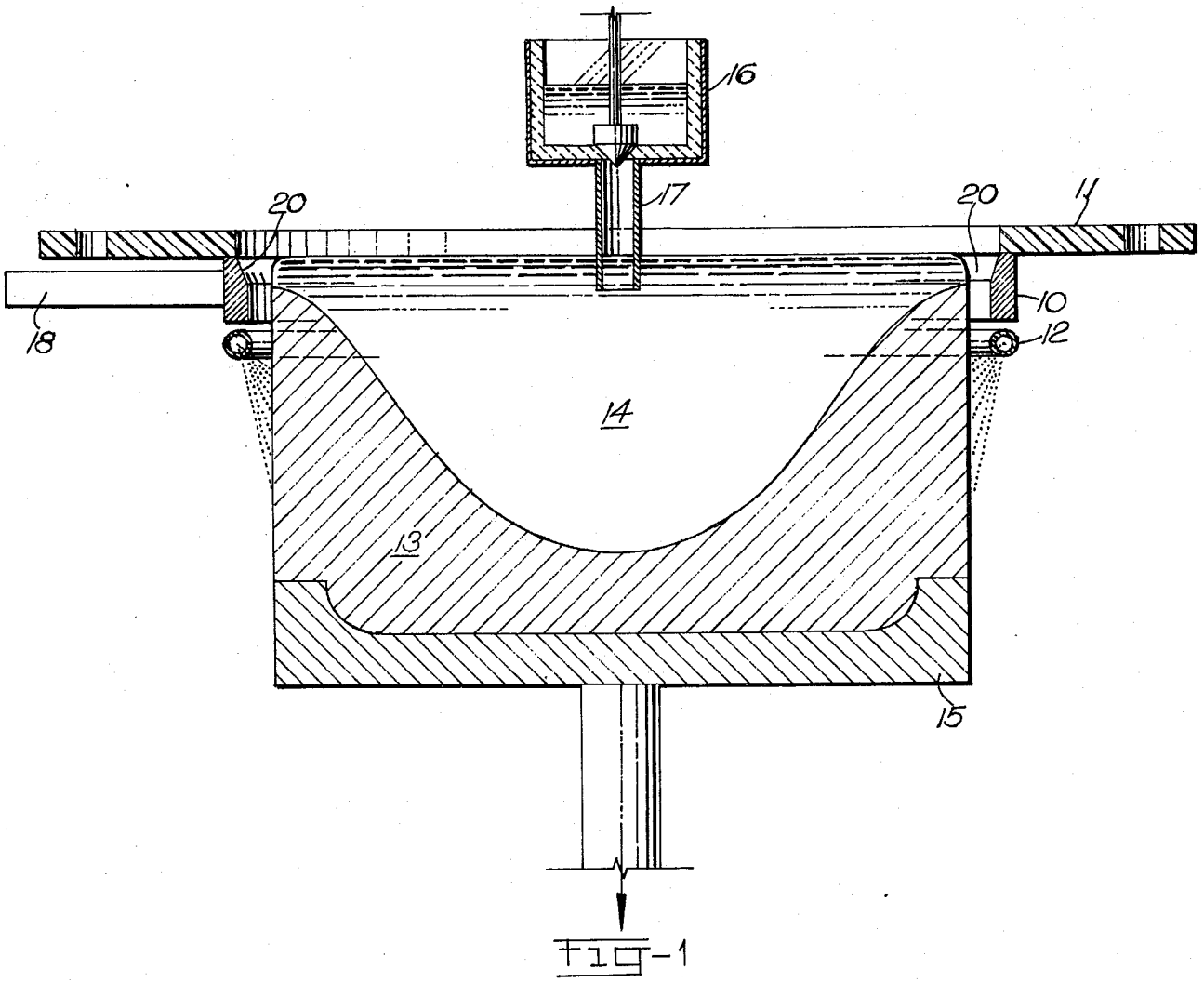
FIG. 1 is an elevational view in section of the apparatus of the invention.

This invention relates to the electromagnetic casting of molten metal, and, in particular, is directed to a modification which provides shape control of the molten metal without high electrical power losses.

The apparatus of the invention generally comprises a ring-type electromagnetic inductor, which controls the shape of molten metal disposed within the inner peripheral area of the inductor, and preferably a coolant source disposed concentrically about the molten metal which is adapted to apply coolant onto the metal surface to effect solidification.

In accordance with the invention, the alternating current electromagnetic field generated by the upper portion of the electromagnetic inductor means has a gradually diminishing flux density so that the radial forces on the molten metal surface are gradually reduced (approximately linearly) toward the upper portion of the molten metal column to maintain the vertical surfaces of the molten metal essentially straight, particularly in the solidification zone, and the corner or corners of the upper molten metal surface relatively sharp, i.e., small radius of curvature. The generation of the diminishing electromagnetic field, the flux density of which diminishes in the vertical direction toward the top of the inductor, is effected either by gradually reducing the current levels in the upper portion of the inductor toward the top thereof, by gradually increasing the distance toward the top of the inductor between the effective upper portion of the inductor surface and the molten metal surface being controlled or by both methods. By generating an electromagnetic field with a diminishing flux density in the upper portion of the inductor as described, the electrical power losses caused by the electromagnetic shield can be significantly reduced. Moreover, by accurately shaping the field in accordance with the present invention, the necessity of using an electromagnetic shield to maintain the vertical surfaces of the metal straight can be minimized or even eliminated. Although the inductor means is primarily described herein as a single inductor, the inductor may be a plurality of inductors and the use of the term herein shall refer to both single or multiple inductors.

The reduced current levels in the upper portion of the inductor means can be effected in several ways. For example, the cross section of the upper portion of the inductor can be gradually reduced in the vertical direction toward the top of the inductor, or the inductor means can be two inductors with the upper inductor carrying less current than a lower inductor. Similarly, the composition of the upper portion of the inductor can be varied toward the top thereof to gradually increase the resistance in the upper section of the inductor toward the top thereof. The same effect can be obtained by roughening the inner surface of the inductor with the severity of the roughness increasing toward the top of the inductor.

The distance between the effective inner surface of the inductor and the molten metal surface is most readily increased by sloping the upper inner surface of the inductor away from the vertical axis toward the top of the inductor, and this method is probably the most effective method of controlling the shape of the molten metal. Other means less effective include milling grooves in the inner surface of the inductor inclined away from the axis of the casting unit in the upper portion of the inductor. However, both of these methods can also reduce the effective cross section of the upper portion of the inductor so the electromagnetic field is diminished both by reduced current and increased distances.

With prior art electromagnetic casting devices, the inductor could not be positioned very close to the electromagnetic shield (and thus close to the molten metal surfaces) because in such cases, the electrical power losses caused by the electromagnetic shield could exceed 50 percent of electrical power input to the inductor. Because such power losses are unacceptable, the inductor in the prior art devices would be positioned much farther away from the molten metal surface being shaped than was desired for shape control. This also increased electrical power requirements but not to the extent described above. With the present invention, the electromagnetic inductor can be placed close to the molten metal surface being controlled with very slight power losses to the electromagnetic shield (e.g., less than 10 percent).

Reference is made to the drawings which illustrate the invention in detail. With specific reference to FIG. 1, the apparatus of the invention generally comprises an electromagnetic inductor 10 which is attached in a suitable manner (not shown) to mounting plate 11. Coolant source 12 is disposed beneath the inductor and is adapted to apply coolant completely around the surface of ingot 13 so as to solidify the molten metal 14. The ingot 13 is supported by bottom block 15. Feed trough 16 is provided to feed molten metal from a source (not shown) through downspout 17 into the inner peripheral area of the inductor means 10. The upper surface 20 of inductor means 10 diverges away from the vertical axis of the inductor 10 and coolant source 12 to diminish the electromagnetic flux density in the vertical direction and thereby gradually reduce in the vertical direction the electromagnetic forces acting against the surface of the molten metal. The gradually reduced pressure maintains the vertical surfaces essentially straight and the corners of the upper surface of the molten metal relatively sharp. Although not shown in FIG. 1, the inductor 10 is preferably provided with a suitable means to control the temperature of the inductor.

Figure 2:
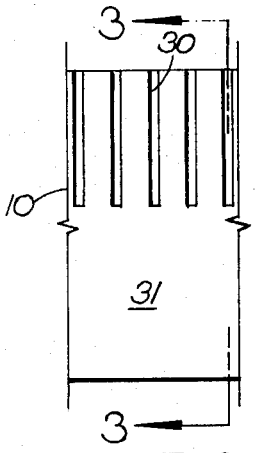
FIGS. 2–5 illustrate various inductors of the invention.
Figure 3:
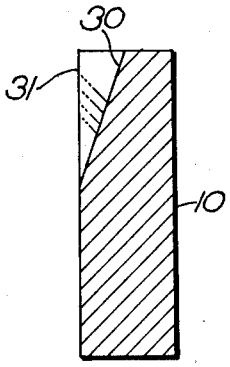

FIGS. 2 and 3 illustrate a modification of the inductor of the invention wherein inclined grooves 30 are milled into the inner surface 31 of the inductor so as to reduce the electromagnetic forces against the molten metal in accordance with the invention. The grooves are inclined in a suitable manner to effect the desired shape of the molten metal surface.

Figure 4:
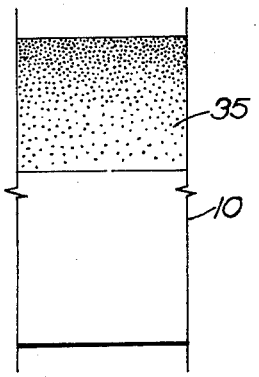

FIG. 4 illustrates a modification of the inductor of the invention wherein the inner surface 35 of the upper portion of the inductor is roughened in a suitable manner with the severity of the surface roughness increasing toward the top of the inductor. The surface roughness can be effected by sand blasting, milling or other suitable methods.

Figure 5:
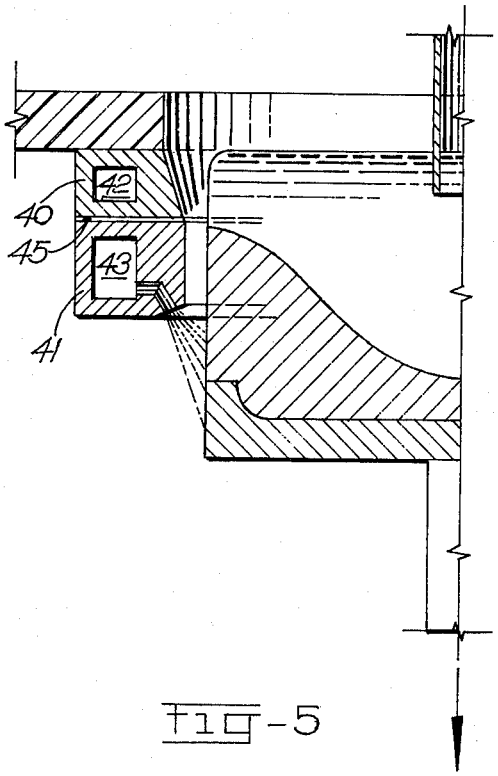

FIG. 5 illustrates an electromagnetic inductor means comprising an upper inductor 40 and a lower inductor 41 with the upper inductor 40 carrying less current than the lower inductor 41. Both inductors are provided with coolant chambers 42 and 43, respectively, to control the temperature of the inductors. The inductors, however, should be electrically insulated from one another such as by a nonconducting member 45.

Figure 6:
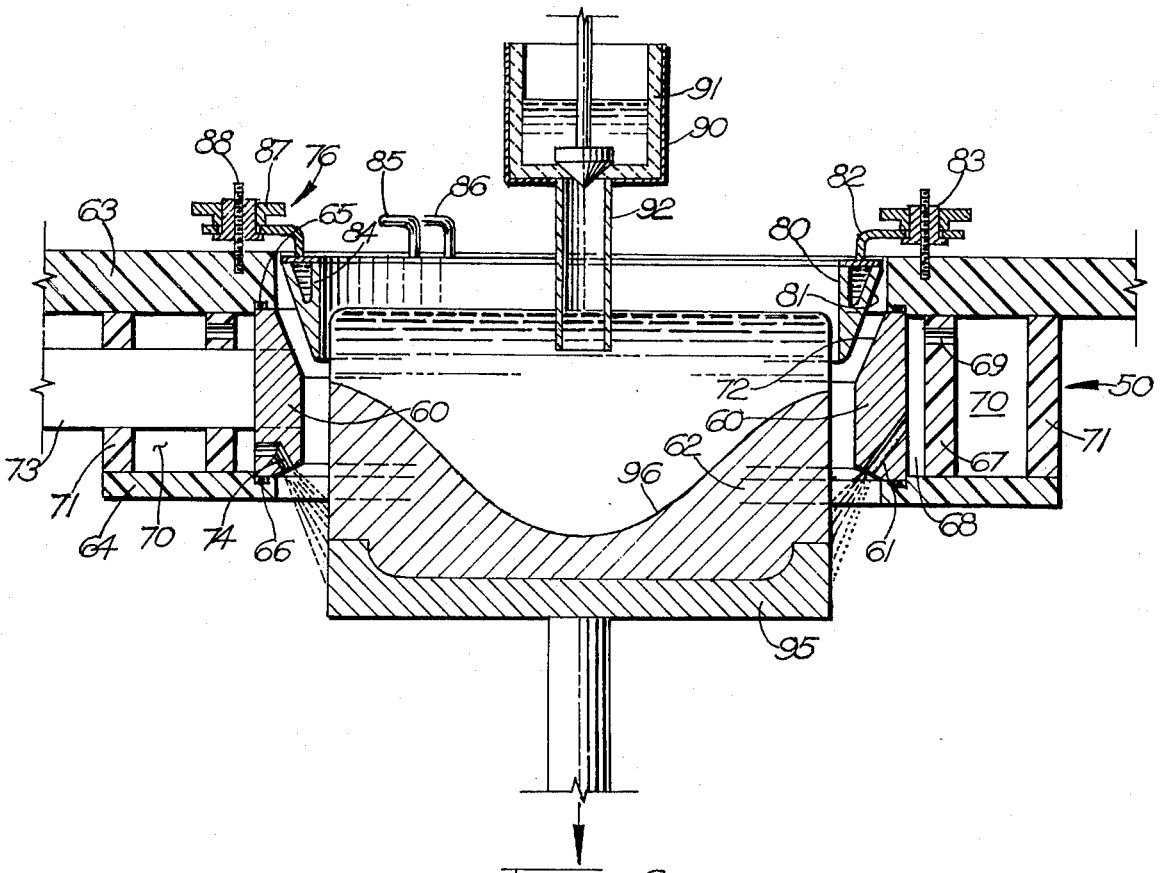
FIG. 6 is an elevational view in section of a preferred embodiment of the invention.

Preferably, the inductor of the invention is utilized as the inner wall of the coolant jacket as shown in FIG. 6 and as claimed in the inventors co-pending application Ser. No. 599,744 filed concurrently herewith. In this embodiment, the coolant jacket-inductor assembly 50 comprises an inductor 60 as the innermost wall of the assembly 50 and is provided with a plurality of coolant-carrying passageways 61 for directing water or other coolant onto the surface of the solidifying ingot 62. The inductor 60 is fixed in sealed relationship with the top member 63 and a bottom member 64 with sealing elements or gaskets 65 and 66 disposed between the mating surfaces. An upstanding baffle member or wall 67 is positioned on bottom member 64 adjacent the outer surfaces of the inductor 60 so as to define a coolant chamber 68 with members 63 and 64. The wall 67 is provided with one or more coolant-carrying passageways 69 to direct coolant to chamber 68 from chamber 70 which is defined by the baffle or wall member 67, members 63 and 64 and side member 71.

Coolant jacket members 63, 64, 67 and 71 should be nonmetallic and nonconducting and generally can be formed of material, such as laminated sheet of epoxy-bonded fiberglass, polyvinyl chloride, polyethylene and the like.

The upper surface 72 of electromagnetic inductor 60 is preferably inclined away from the vertical axis of the casting assembly toward the top of the inductor to reduce the electromagnetic forces on the upper portion of the molten metal in accordance with the preferred embodiment of the invention. The vertically inclined outer surface 81 of the electromagnetic shield 80 is generally parallel to the inclined inductor surface 72 to thereby allow the inductor 60 to be positioned much closer to the solidifying ingot than prior art designs. The angle of surface 72 with the vertical varies depending upon such factors as metal head and the like. Usually, the desired angle is empirically determined but generally is between 20° and 60°.

Inductor leads 73 are electrically connected to the outer surface of inductor 60 preferably with a highly conductive solder, such as a silver containing solder, between the mating surfaces. In the area of the inductor 60 where the electrical leads 73 are attached, the coolant passageways 74 for directing coolant onto the emerging ingot are modified to accommodate for the connection as shown in the drawing. However, the discharge angle of the coolant through the conduits 74 should be the same as that provided by the other coolant passageway 61 so as to not detrimentally affect the cooling or solidification pattern in the ingot. The ends of the inductor 60 and the adjoining surfaces of the leads 73 are electrically from one another by a sheet of suitable nonconducting material, such as laminated sheet formed from silicon-bonded fiberglass cloth. To reduce the magnetic field generated outside the inductor 60, a plurality of vertical grooves can be milled into the outer surface of the inductor.

The inductor 60 may be formed from highly conductive material, such as 99.9+percent electrolytic tough pitch copper and is generally of the shape of the desired ingot cross section. For safety reasons, the innermost surface of the inductor should be thinly coated with a suitable nonconducting material, preferably refractory in nature, such as Sauereisen electrical resistor cement No. P-78 sold by the Sauereisen Company.

The electromagnetic shield assembly 77 disposed partially above the inductor 60 comprises an electromagnetic shield 80 formed of nonmagnetic metallic material having a relatively high resistivity such as stainless steel. The shield 80 is supported by a plurality of L-shaped support members 82 which are associated with height adjusting means 83. Preferably, a coolant chamber 84 is provided within the electromagnetic shield 80 which is supplied with coolant from conduits 85 and 86 in the top of the electromagnetic shield 80. The shield is raised or lowered by turning the handles 87 on the threaded posts 88 which are fixed in a suitable manner to upper member 63 of the coolant jacket assembly. The electromagnetic shield allows for a much finer control of the molten metal shape. However, because of the geometry of the improved inductor of the invention, the electromagnetic shield does not consume the amount of electrical power characterized by the prior art shields.

The molten metal feeding assembly 90 comprises a refractory lined feed trough 91 for directing molten metal from a furnace or other molten metal holding device (not shown) to the casting assembly. Molten metal flows from the trough 91 through refractory downspout 92 into the inner peripheral area of the inductor 60. The molten metal flowing through downspout 92 is restricted by metering element 93 to control the level of molten metal column within the electromagnetic field. Metering element 93 can be actuated in a suitable fashion, such as by a conventional float assembly (not shown) or another equivalent device. It is recognized that other means can be employed to feed molten metal to the casting assembly.

In the operation of the apparatus shown in FIG. 6, the bottom block 95 is raised into position within the inner peripheral area of the inductor 60 beneath the electromagnetic shield 80. High frequency electrical power of about 500–3000 cps is supplied to the inductor to generate the necessary electromagnetic field. Coolant (usually water) in chamber 70 flows through conduits 69 into chamber 68 and out conduits 61 and 74. Molten metal is introduced to trough 91 wherein it flows through downspout 92 and onto the bottom block 95, The forces generated by the electromagnetic field immediately begin to shape the molten metal in the desired manner and casting begins. Generally, with light metals, such as aluminum and aluminum alloys, the solidification front 96 in the metal being cast will be bell-shaped as shown in FIG. 6. The solidification front on the molten metal surface should lie about the midpoint of the inductor as shown. Coolant application onto the metal surface is usually below the solidification front. Although the demarcation between the molten and solidified metal is shown in the drawings as being quite distinct, in fact, there is a mushy zone of partially solidified metal about 0.1–2.0 inches thick between the solidified and molten metal. The thickness of the semisolidified zone at a particular location within an ingot depends upon cooling rates and alloy composition.

Because of the close proximity of the inductor to the molten metal surface being controlled and the upwardly diminishing electromagnetic field generated by the upper portion of the electromagnetic induction means, the electrical power requirements for field generation are considerably reduced by the invention. For example, in casting a 45 ×20 inches rolling ingot of 5182 aluminum alloy (Aluminum Association alloy designation) by means of the casting assembly of the invention, the required voltage was about 30 kilowatts with an inductor-to-molten metal distance of 0.5 inch (measured from the vertical surface of the inductor). Prior art electromagnetic casting units required about 100–120 kilowatts for the same sized ingot with an inductor-to-molten metal distance of about 1.0 inch.

The electromagnetic casting assembly described in detail herein is primarily designed for casting light metals, such as aluminum and alloys thereof, which have a relatively short molten metal sump during casting. However, when casting alloys having relatively low conductivities, such as steel, the length of the electromagnetic field along the axis of the assembly may be extended considerably over that shown and described herein for light metal products.

It is obvious that various modifications and improvements can be made to the invention without departing from the spirit thereof and the scope of the appended claims.

What is claimed is:

1. In an electromagnetic apparatus for the continuous or semicontinuous casting of metal ingots or billets comprising a means to feed molten metal, a ring-type metallic electromagnetic inductor means for generating electromagnetic forces which control the shape of molten metal fed from the feeding means and disposed within the inner peripheral area of the inductor means and means for cooling the shaped molten metal surfaces to solidify the molten metal in essentially the shape imposed on the molten metal by the electromagnetic forces, the improvement comprising a ring-type metallic electromagnetic inductor provided with means for generating an electromagnetic field having a flux density which diminishes in intensity toward the top of the inductor means to control the shape of the molten metal within the inner peripheral area of the inductor means so that the vertical surface or surfaces of the molten metal are essentially straight.

2. The electromagnetic casting apparatus of claim 1 wherein a coolant source is provided about the column of metal to direct coolant onto the surface of said column so as to cause the solidification thereof.

3. The electromagnetic casting apparatus of claim 1 wherein the upper portion of the inner surface of the inductor means is inclined away from the vertical axis of the casting apparatus to diminish the flux density of the electromagnetic field toward the top of the inductor means.

4. The electromagnetic casting apparatus of claim 1 wherein the upper portion of the inner surface of the inductor means is provided with grooves which are inclined away from the vertical axis of the casting apparatus to diminish the flux density of the electromagnetic field toward the top of the inductor means.

5. The electromagnetic casting apparatus of claim 1 wherein the upper portion of the inner inductor surface is roughened with increasing severity toward the top of the inductor means to diminish the intensity of the electromagnetic field toward the top of the inductor means.

6. The electromagnetic casting apparatus of claim 1 wherein an electromagnetic shield is disposed between the upper portion of the inductor means and the controlled molten metal surface to attenuate the diminishing electromagnetic field.

7. The electromagnetic casting apparatus of claim 1 wherein the inductor means comprises a plurality of stacked ringtype inductor with the uppermost inductor generating an electromagnetic field of lesser intensity than the underlying inductor or inductors.

8. The electromagnetic casting apparatus of claim 1 adapted to cast aluminum and aluminum alloys.

* * * * *

UNITED STATES PATENT OFFICE
CERTIFICATE OF CORRECTION

PATENT NO. : 3,985,179
DATED : October 12, 1976
INVENTOR(S) : David G. Goodrich and John Ludwig It is certified that error appears in the above-identified patent and that said Letters Patent are hereby corrected as shown below:

Title Page, below Patent No., "Oct. 21, 1976" should be --Oct. 12, 1976--

Column 3, line 42, "provides shape" should be --provides improved shape--

Column 6, line 22, "electrically from" should be --electrically insulated from--

Signed and Sealed this
Tenth Day of May 1977

[SEAL]

*Attest:*

RUTH C. MASON
*Attesting Officer*

C. MARSHALL DANN
*Commissioner of Patents and Trademarks*